US009066190B2

(12) United States Patent
Lafort et al.

(10) Patent No.: US 9,066,190 B2
(45) Date of Patent: Jun. 23, 2015

(54) HEARING AID WITH A PUMP ARRANGEMENT

(71) Applicant: Sonion Nederland B.V., Hoofddorp (NL)

(72) Inventors: Adrianus Maria Lafort, Delft (NL); Paul Christiaan van Hal, Amsterdam (NL)

(73) Assignee: Sonion Nederland B. V., Hoofddorp (NL)

( * ) Notice: Subject to any disclaimer, the term of this patent is extended or adjusted under 35 U.S.C. 154(b) by 0 days.

(21) Appl. No.: 14/063,435

(22) Filed: Oct. 25, 2013

(65) Prior Publication Data

US 2014/0119584 A1 May 1, 2014

Related U.S. Application Data

(60) Provisional application No. 61/718,571, filed on Oct. 25, 2012.

(51) Int. Cl.
*H04R 25/00* (2006.01)
*H04R 1/10* (2006.01)

(52) U.S. Cl.
CPC ..... *H04R 25/65* (2013.01); *H04R 25/652* (2013.01); *H04R 1/1016* (2013.01); *H04R 25/656* (2013.01)

(58) Field of Classification Search
CPC .... H04R 25/65; H04R 25/652; H04R 25/656; H04R 1/1016; H04R 2225/025; H04R 2225/61
USPC ..... 381/322, 324, 325, 326, 327, 328, 330, 381/380, 381; 181/129, 130, 135; 128/864, 128/865, 866
See application file for complete search history.

(56) References Cited

U.S. PATENT DOCUMENTS

| | | | | |
|---|---|---|---|---|
| 5,133,016 | A * | 7/1992 | Clark | 381/328 |
| 6,361,294 | B1 * | 3/2002 | Witzigreuter et al. | 417/413.3 |
| 6,475,658 | B1 * | 11/2002 | Pedicini et al. | 429/407 |
| 8,340,335 | B1 * | 12/2012 | Shennib | 381/328 |
| 8,526,652 | B2 * | 9/2013 | Ambrose et al. | 381/328 |
| 2003/0026444 | A1 * | 2/2003 | de Roo et al. | 381/369 |
| 2009/0028356 | A1 | 1/2009 | Ambrose et al. | |
| 2010/0322454 | A1 | 12/2010 | Ambrose et al. | |
| 2011/0182453 | A1 * | 7/2011 | Van Hal et al. | 381/328 |
| 2011/0228964 | A1 | 9/2011 | Ambrose et al. | |
| 2011/0311069 | A1 * | 12/2011 | Ambrose et al. | 381/71.6 |
| 2012/0057734 | A1 | 3/2012 | Ambrose et al. | |
| 2012/0140966 | A1 * | 6/2012 | Mocking et al. | 381/322 |
| 2012/0155694 | A1 * | 6/2012 | Reeuwijk et al. | 381/396 |
| 2012/0217087 | A1 | 8/2012 | Ambrose et al. | |

* cited by examiner

*Primary Examiner* — Huyen D Le
(74) *Attorney, Agent, or Firm* — Nixon Peabody LLP

(57) ABSTRACT

A hearing aid comprising a behind-the-ear unit comprising a pump arrangement which is fluidly connected to an inflatable part of an in-the-ear unit. The pump arrangement comprises one inlet valve and two outlet valves which are arranged in series. The valve leakage of the two outlet valves is not identical.

10 Claims, 4 Drawing Sheets

HEARING AID WITH A PUMP ARRANGEMENT

CROSS-REFERENCE TO RELATED APPLICATION

This application claims the benefit of U.S. Provisional Patent Application No. 61/718,571, filed Oct. 25, 2012, entitled "A Hearing Aid with a Pump Arrangement" which is hereby incorporated by reference in its entirety.

FIELD OF THE INVENTION

The present invention relates to a hearing aid comprising a behind-the-ear unit comprising a pump arrangement which is fluidly connected to an inflatable part of an in-the-ear unit. The pump arrangement comprises one inlet valve and two outlet valves which are arranged in series. The valve leakage of the two outlet valves is not identical.

BACKGROUND OF THE INVENTION

In a first aspect the present invention relates to a hearing aid comprising a behind-the-ear unit, an in-the-ear unit and an interconnecting element arranged therebetween, wherein the in-the-ear unit comprises an inflatable element which when inserted into an auditory canal of a user may be inflated to abut an inner surface of the auditory canal so as to retain the inflatable element in the auditory canal, wherein the interconnecting element defines at least one conduit which is fluidly connected to the inflatable element and to a pump arrangement which is provided in and/or on the behind-the-ear unit; wherein the pump arrangement comprises:

- a pump chamber defining an inlet and an outlet;
- a unidirectional inlet valve provided in the inlet, the inlet valve allowing downstream flow of air into the pump chamber and limiting upstream flow of air out of the pump chamber;
- a unidirectional first outlet valve provided in the outlet, the first outlet valve allowing downstream flow of air out of the pump chamber and limiting upstream flow of air into the pump chamber; and
- a unidirectional second outlet valve provided downstream relative to the first outlet valve, the second outlet valve allowing downstream flow of air and limiting upstream flow of air;
- wherein a valve leakage of the second outlet valve is lower than the valve leakage of the first outlet valve, the valve leakage being defined as the flow rate of air leaking/flowing through the valve in the upstream direction, when the valve is closed.

The outlet of the pump arrangement comprises two valves which are arranged in series. The first outlet valve is less tight than the second outlet valve. The provision of the second tighter valve prevents or limits backflow of air from the inflatable element and back into the pump chamber. At the same time, the first valve may be a valve which opens more rapidly than the second valve. This way, it may be ensured that the overpressure provided by the pump (which is arranged downstream the first outlet valve) may be quickly transferred downstream the first outlet valve and subsequently gradually through the second outlet valve as the second outlet valve opens more slowly. Moreover, as the second outlet valve is more tight, any air which passes through the second valve is less likely to flow back upstream.

SUMMARY OF INVENTION

In the context of the present invention, the first inlet valve may also be called a unidirectional inlet rectifier valve. In the context of the present invention, the first outlet valve may also be called a unidirectional outlet rectifier valve. In the context of the present invention the second outlet valve may also be called a unidirectional outlet check-valve.

Each of the valves is adapted to change between a closed and an open position and the valve is designed such that the valve is biased towards its closed position. In one embodiment, one or more of the valves are formed as a resilient materiel which is biased to cover a passage. The resilient material may be flap-shape i.e. made from a thin material which is secured along one edge such that it may flap between the closed and the open position.

The pump chamber comprises one or more inlets and one or more outlets. If more than one inlet is provided, an inlet valve may be provided in each of the inlets. Alternatively, one or more inlets may be fluidly connected to a common inlet valve. Similarly, one or more of the outlets may be provided. If more than one outlet is provided, each outlet may comprise a first and a second outlet valve. Alternatively, one or more of the outlets may be fluidly connected to a common first outlet valve and a common second outlet valve.

As an alternative to an inlet valve, an inlet flow resistance member/means/arrangement/passage may be provided. This may e.g. be a more narrow section in an inlet tube. It will be appreciated that while a unidirectional inlet valve in the electrical domain corresponds to an electrical diode, a flow resistance member in the electrical domain corresponds to an electrical resistance.

Similarly, the first outlet valve may be substituted with a flow resistance member/means/-arrangement/passage.

In the context of the present invention, the term valve leakage shall be defined as the flow rate of air flowing/leaking through the valve in the upstream direction (at a predetermined reference pressure), while the valve is closed. It will be appreciated that a valve may be more or less tight and that when an engineer is designing a system he may have to choose solutions which is a compromise of several parameters. As an example an engineer may choose to have a faster responding valve instead of a very tight valve which is slow to respond i.e. a difference in valve velocity.

In one embodiment, the valve leakage of the second outlet valve is 10 percent lower than the valve leakage of the first outlet valve, such as 20 percent lower, such as 30 percent lower, such as 40 percent lower, such as 50 percent lower, such as 60 percent lower, such as 70 percent lower, such as 80 percent lower, such as 90 percent lower, such as 100 percent lower, such as 150 percent lower, such as 200 percent lower.

In one embodiment, the valve leakage of the second outlet valve is an order of magnitude 10 lower than the valve leakage of the first outlet valve. Preferably the valve leakage is multiple orders of magnitude lower.

In order to allow the compressed air to slowly pass through the second outlet valve in a downstream direction, a buffer chamber may be defined between the first outlet valve and the second outlet valve. In one embodiment, the volume of the buffer chamber is of approximately the same volume as the pump chamber. In another embodiment, it may differ in volume by an order of magnitude smaller or an order of magnitude larger.

As mentioned above the valve opening velocity of the two outlet valves may be non-identical. Thus in one embodiment, a valve opening velocity of the first outlet valve is higher than the valve opening velocity of the second outlet valve, the valve opening velocity being defined as the time it takes the valve to change from a closed state to an open state when the valve is subjected to a predetermined relative pressure. In some embodiments, the valve velocity may be defined as the time it takes the valve to change from the fully closed state to a half open state.

In one embodiment, the valve opening velocity of the first outlet valve is 10 percent higher than the valve velocity of the second outlet valve, such as 20 percent higher, such as 30 percent higher, such as 40 percent higher, such as 50 percent higher, such as 75 percent higher, such as 100 percent higher (i.e. twice as high), such as 200 percent higher, such as 300 percent higher.

In one embodiment, the valve velocity of the inlet valve corresponds to the stroke frequency of the pump. More preferably, the valve velocity of the inlet valve is higher than the pump frequency.

In order to pressurize the inflatable element the hearing aid comprises a pump. In one embodiment, a pump is arranged in the pump chamber or defines the pump chamber. The pump may be arranged inside the behind-the-ear unit or may be attached to the outer surface. In one embodiment, the pump is accessible from an outer surface of the behind-the-ear device. As an example, the pump may be a manual pump (such as a bellows pump) provided on the outer surface of the behind-the-ear unit. In the latter case the inlet of the pump arrangement may be defined by the manual pump. Alternatively, the pump may be an electrical pump. In one particular embodiment, the pump is a receiver as known in the hearing aid industry. It will be appreciated that when a receiver generates sound it moves air and thus a receiver may be used for moving air into the inflatable element. Thus by providing a receiver inside the pump chamber, it may be used as a pump. The receiver is preferably operated at its resonance frequency.

A receiver as pump typically produces a pressure of about 10 kPa, resulting in a pressure build-up of 2-3 kPa downstream of the second outlet valve. The second outlet valve preferably opens after 3-5 strokes of the pump having pumped air in the buffer chamber.

The pump is to work over a wide range of operating conditions, namely from the starting condition when the balloon is empty (no pressure, only flow) to the filled balloon condition (no flow, static pressure). A membrane pump is capable thereof. Preferably the membrane is driven by a resonant actuator, such as a balanced armature motor applied for hearing aid receivers. Below the resonance frequency of the pump, the power consumption is almost independent of the drive frequency, while the flow is proportional with the drive frequency. This means that the efficiency is proportional with the drive frequency and the design should be optimized so that it can be operated at the highest possible drive frequency.

However, the efficiency is also dependent of the resonance frequency of the first outlet valve. A study showed that the resonance frequency of the first outlet valve should at least be higher than the drive frequency of the pump, such as 3 times higher, such as 5 times higher. For a given design, the valve resonance frequency can be maximized by increasing its stiffness; While taking in account that a high stiffness may limit the valve from opening far enough, resulting in a too high flow resistance of the open valve. The open valve resistance should be low enough the ensure pressure equalization within the outlet cycle.

For the second outlet valve the resonance frequency is of less influence, it foremost should provide a low valve leakage. For example pressure leakage for 1 cc volume pressurized to 1000 Pa above atmospheric pressure over a period of time of 12 hours less than 200 Pa.

In a second aspect, the present invention relates to a pump arrangement for use in a hearing aid according to any of the preceding claims.

It will be appreciated that the invention according to the second aspect may comprise any combination of features and elements of the invention according to the first aspect.

BRIEF DESCRIPTION OF THE DRAWINGS

The invention will now be described with reference to the figures in which.

DETAILED DESCRIPTION OF PREFERRED EMBODIMENTS

Figure 1:
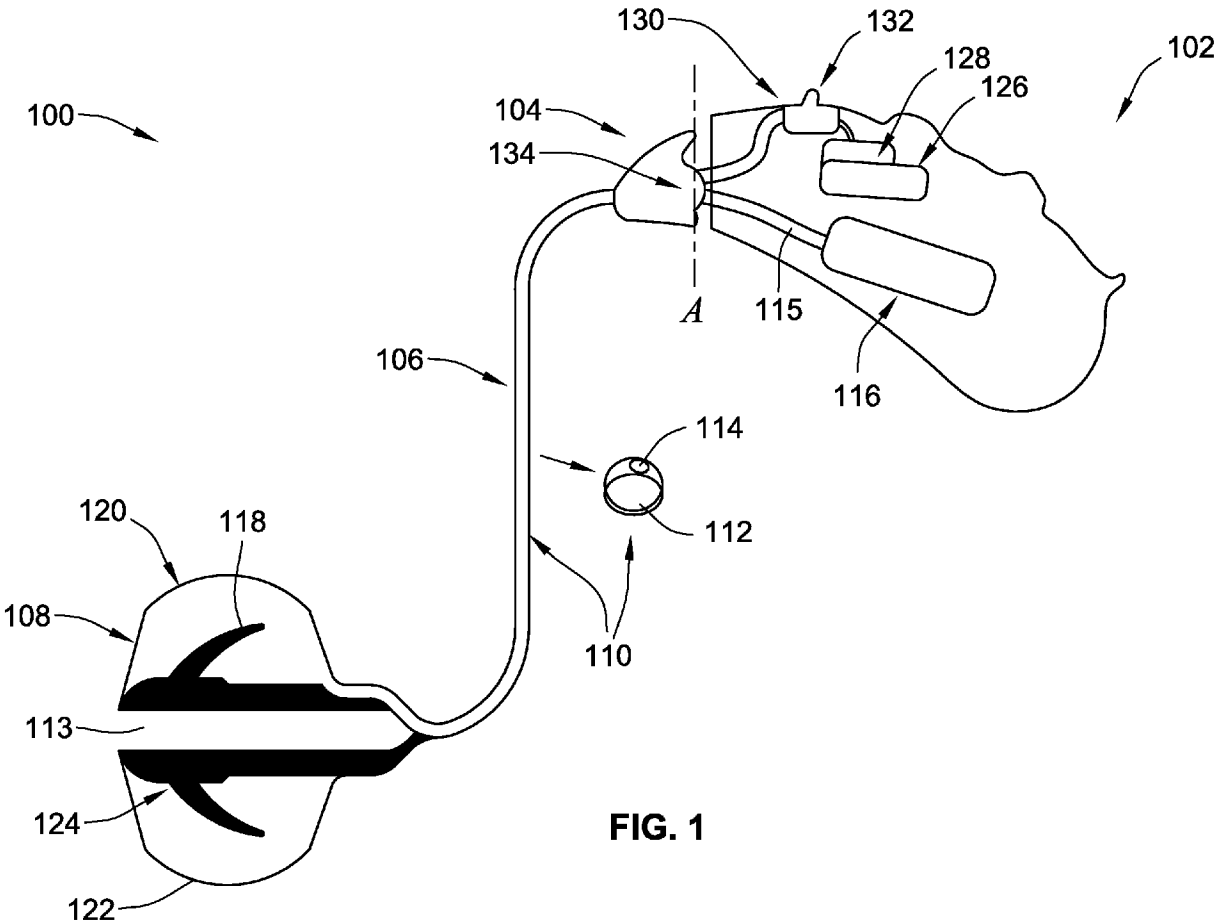
FIG. 1 discloses a hearing aid according to the invention.

FIG. 1 discloses a hearing aid 100 comprising a behind-the-ear part 102, a behind-the-ear part adaptor 104, an interconnecting tube 106 and an ear piece 108. The hearing aid assembly 100 comprises two parts which may be disconnected from each other. A first part comprising the behind-the-ear part 102 and a second part comprising the behind-the-ear part adaptor 104, the interconnecting tube 106 and the ear piece 108. From the FIG. 1 it will be appreciated that the interconnecting tube 106 interconnects the ear piece 108 and the behind-the-ear party adaptor 104. By allowing the behind-the-ear part adaptor 104 to be disconnected from the behind-the-ear part 102, the second part may be replaced by a new second part while at the same time reusing the first part (i.e. the behind-the-ear part adaptor 104 is replaced). In one embodiment, the interconnecting tube 106 is detachably connected to the behind-the-ear part adaptor 104 and/or to the ear piece 108. In another embodiment, the interconnecting tube 106 is permanently connected to one or both of the behind-the-ear part 102 and the behind-the-ear part adaptor 104.

The interconnecting part may define a bi-lumen system 110, defining a first lumen 112 and a second lumen 114. In the embodiment of FIG. 1, the first lumen 112 is at one end fluidly connected to a passage 113 of the ear piece 108 which allows sound to propagate into the auditory canal of the user. The other end of the first lumen 112 is connected to a receiver 116 of the behind-the-ear part 102 through a passage 115 defined in the behind-the-ear part 102 and the behind-the-ear part adaptor 104. Thus when sound is generated by the receiver 116 it propagated through the passage 115 in the behind-the-ear part adaptor 104, further through the first lumen 112 of the interconnecting tube 106 into the passage 113 of the ear piece 108, and further into the auditory canal of the user.

The second lumen 114 of the interconnecting tube is fluidly connected to an inflatable cavity 118 of the ear piece 108. The inflatable cavity 118 is arranged such that it defines an outer circumferential surface 120 of the ear piece. In one embodiment, the inflatable cavity 118 defines a torus/donut. In another embodiment, the inflatable cavity defines a sphere. When a fluid such as air, is pumped or blown into the inflatable cavity 118, the inflatable cavity 118 is caused to expand radially. Thus when provided inside the auditory canal of the user, the outer surface 120 of the inflatable cavity 118 will gradually be brought into to contact with an inner surface (not shown) of the auditory canal of the user. Once the desired pressure is applied to said inner surface, the pumping action may be halted by the user. Accordingly, by pumping air into the inflatable cavity 118 the ear piece 108 may be retained in the auditory canal. It will be appreciated that one advantage of the inflatable ear piece 108 is that it need not be customised to a specific user, as the user simply just adjusts the pressure to the desired level. Moreover, it will be realised that as the walls 122 of the inflatable cavity 118 are made of a flexible material (such that it is capable of expanding), the walls 122 will adjust their shape to the shape on the auditory canal of the user.

Inside the inflatable cavity, a dome 124 is provided which is arranged to bias the wall 122 of the inflatable cavity 118 away from a completely collapsed state.

In order to pump air into the inflatable cavity, a pump 126 is provided at the other end of the second lumen 112. A valve arrangement 128 is provided which secures that air blown into the second lumen 114 remains therein unless the user desires to remove the air. In order to be able to remove the air, the behind-the-ear part 102 is provided with a release valve 130 which is fluidly connected to the valve arrangement 128 and to the second lumen 114. Accordingly, if the user desires to remove the inflatable ear piece or if too much air has been blown into the inflatable cavity, the user may press the release valve 130 whereby the air contained inside the second lumen 114 and in the inflatable cavity 118, is free to escape. The release valve comprises a button 132 which is accessible from outside the behind-the-ear part 102.

As previously mentioned, the behind-the-ear part 102 and the behind-the-ear part adaptor 104 are detachable from each other. The area of separation is disclosed by line A, see ref. 134.

Figure 2:
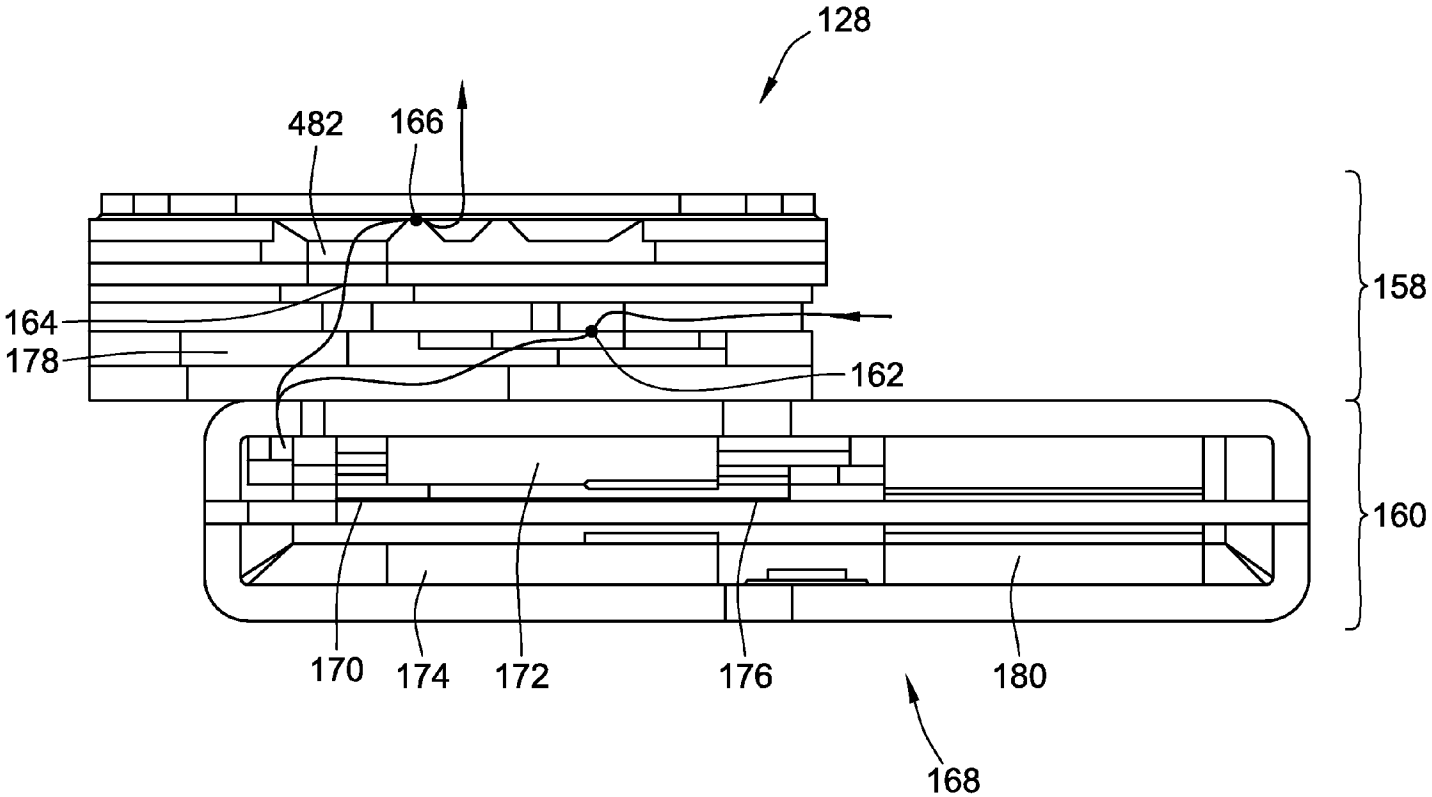
FIG. 2 discloses a pump arrangement according to the invention

FIG. 2 discloses a valve arrangement 128 according to one embodiment of the invention. The valve arrangement 128 comprises an upper part 158 and a lower part 160. The upper part 158 comprises an inlet valve 162, a first outlet valve 164 and a second outlet valve 166. The lower part comprises a receiver 168. The receiver 168 comprises a movable leg portion 170 which is provided between an upper magnet 172 and a lower magnet 174. Moreover, the movable leg portion 170 is secured to a membrane 176, which when the movable leg portion 170 moves causes an under pressure or an over pressure to be created in the pump chamber 178. In order to move the movable leg portion 170, a coil 180 is provided.

During operation the movable leg portion 170 is caused to move up and down by applying an altering current to the coil 180. This movement causes the abovementioned under and over pressure to be created in the pump chamber 178. When an under pressure is created, air is sucked into the pump chamber through the valve inlet 162. When an over pressure is created, air is expelled from the pump chamber 178, through the first and the second outlet valve 164,166. Between the first outlet valve and the second outlet valve 166, a buffer chamber 182 is defined.

The first outlet valve 164 has a more rapid valve opening velocity than the second outlet valve 166, while the second outlet valve 166 had lower valve leakage (i.e. it is more leakage tight when closed). Thus, when an overpressure is created in the pump chamber 178, the first outlet valve 164 rapidly will open and the pressure in the pump chamber 178 and a buffer chamber 182 will equalize. When the pressures have equalised, the first valve will close as no over-pressure in the pump chamber 178 (relative to the buffer chamber 182) exist. This is due to the valve being biased towards its closed state. The pressure in the buffer chamber 182 will cause the second outlet valve to open, provided that the pressure in the buffer chamber 182 is larger than the pressure downstream the second outlet valve. Although the first outlet valve is not as tight as the second outlet valve it will maintain its pressure sufficiently long for the second outlet valve to open. This valve will remain open until the pressure in the buffer chamber is equal to the pressure downstream the second outlet valve. When the two pressures are identical the second outlet valve will close and due to the good sealing capabilities of the second outlet valve no or very little air will flow/leak in the upstream direction through the second outlet valve.

Figure 3:
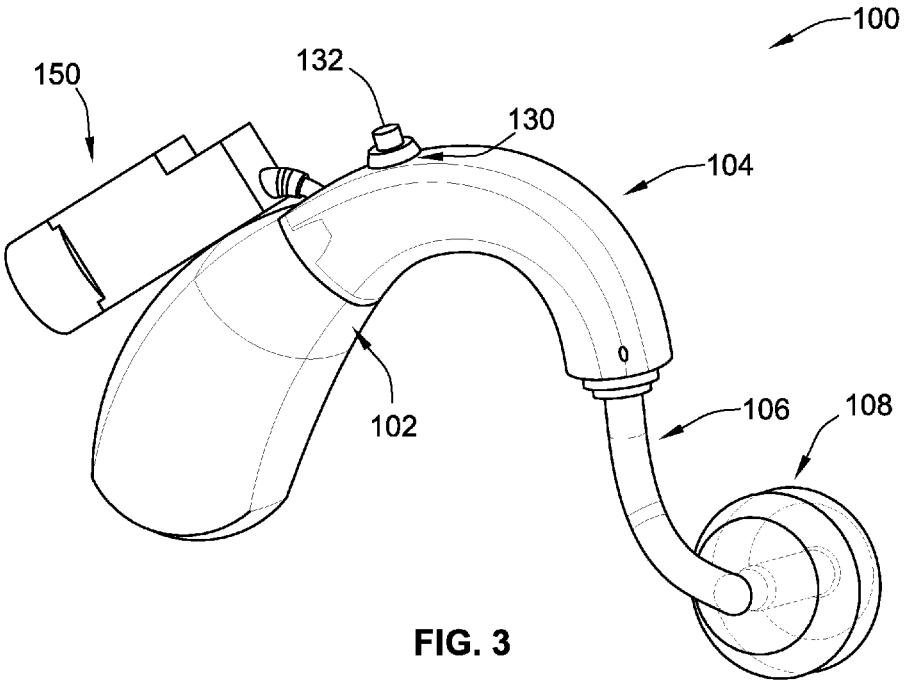
FIG. 3 discloses a hearing aid comprising a manual pump for pumping air into the inflatable ear piece, FIG. 4 discloses a release button of the behind-the-ear part adaptor, FIG. 5 discloses a two outlet valves, and FIG. 6 discloses a detail of the hearing aid of FIGS. 3 and 4.
Figure 4:
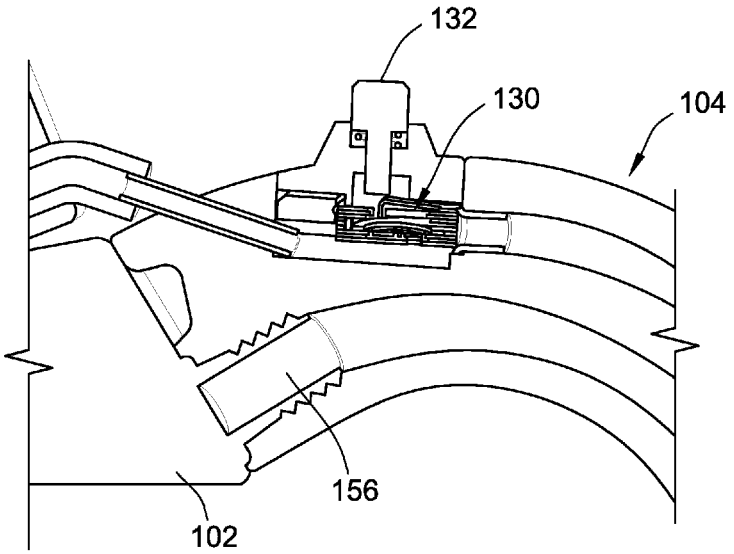

FIGS. 3 and 4 disclose a hearing aid 100 comprising a behind-the-ear part 102, a behind-the-ear part adaptor 104, an interconnecting tube 106, an ear piece 108. In order to pump air into the second lumen 114 and thus also into the inflatable cavity 118, a manual pump 150 is fluidly connected to the fluid connector 148 such that it is accessible from an outer surface of the hearing aid assembly 100. The manual pump 150 is detachably and re-attachably attached to the fluid connector whereby it may be reused when the behind-the-ear part adaptor 104 is to be replaced.

In order to be able to release air from the second lumen 114 and the inflatable cavity 118, a release valve 130 is provided. The release valve 130 is operable by the user from an outer surface of the hearing aid assembly 100 by means of a button 132. The release valve 130 defines an open state when the button 132 is depressed and a closed state when the release valve 130 is not depressed. The release valve 130 comprises means for biasing the valve 130 into the closed state.

It will be appreciated that the hearing aid assembly 100 may also in some embodiments comprise an electrical pump (e.g. in the form of a receiver) which the user may operate by means of activation buttons (not shown) provided on an outer surface of the hearing aid assembly 100 e.g. on an outer surface of the behind-the-ear part 102 or the behind-the-ear part adaptor 104.

A receiver 116 is provided in the behind-the-ear part and in order for the sound generated by the receiver 116 to propagate in the first lumen, a first lumen connector 156 is provided which engages the first lumen 112 of the behind-the-ear part adaptor 104, when hearing aid assembly 100 is assembled.

Figure 5:
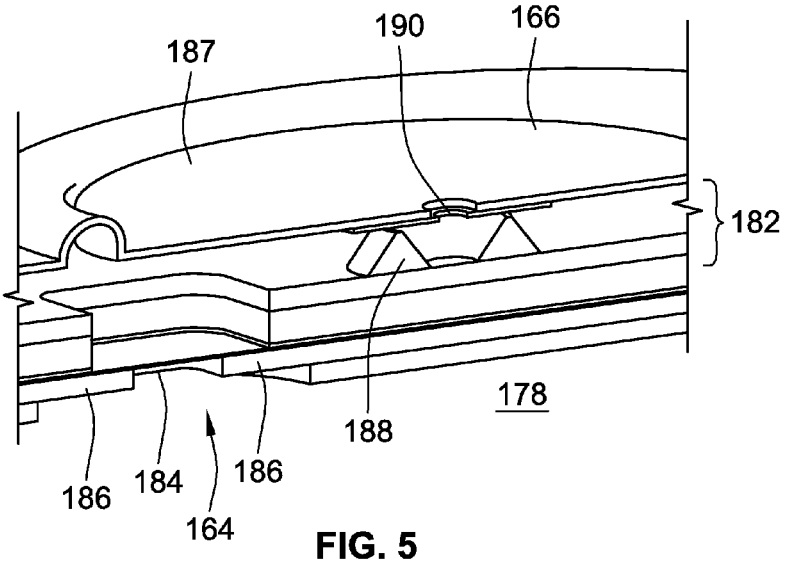

FIG. 5 discloses the first outlet valve 164, the second outlet valve 166, buffer chamber 182 and the pump chamber 178. The first outlet valve 164 is provided in the form of a flap 184 which is movable between an open and a closed state. In the closed state the flap 184 abuts a surface of a member 186 whereby air is prevented from flowing in the upstream direction (i.e. downwards in the drawing). The buffer chamber 182 is defined between the first and the second outlet valve. The second outlet valve is defined as a membrane 187 which is movable up and down in response to the pressure difference between the upstream and the downstream side of the valve. When the membrane 186 is caused to move upwards, the valve opens and air may flow between the membrane 186 and the member 188 out through the passage 190.

Figure 6:
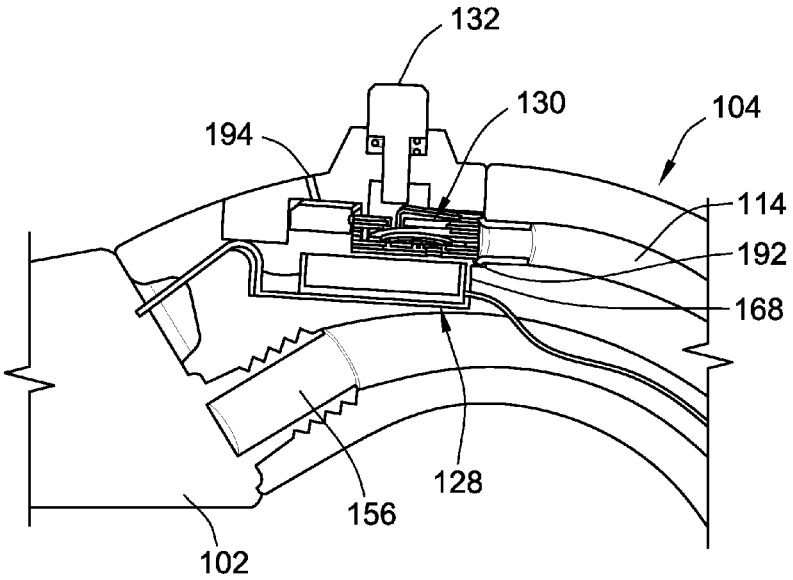

FIG. 6 discloses a detail of a behind-the-ear part adapter 104 and a behind-the-ear part 102. Inside the behind-the-ear part adapter 104 is provided a valve arrangement 128 comprising a receiver 168 (as known from the hearing aid industry) and a valve arrangement 192. On top of the valve arrangement is provided a release valve 130. When the receiver 168 is operated, air is sucked into the valve arrangement through the inlet 194 and into the pump chamber as is described previously. Subsequently, the air is blown out through the two outlets of the valve arrangement 192 and into the second lumen 114 and further into the inflatable cavity (not visible).

The invention claimed is:

1. A hearing aid comprising a behind-the-ear unit, an in-the-ear unit and an interconnecting element arranged therebetween, wherein the in-the-ear unit comprises an inflatable element which when inserted into an auditory canal of a user may be inflated to abut an inner surface of the auditory canal so as to retain the inflatable element in the auditory canal, wherein the interconnecting element defines at least one conduit which is fluidly connected to the inflatable element and to a pump arrangement which is provided in or on the behind-the-ear unit; wherein the pump arrangement comprises:

a pump chamber defining an inlet and an outlet;

a unidirectional inlet valve provided in the inlet, the inlet valve allowing downstream flow of air into the pump chamber and limiting upstream flow of air out of the pump chamber;

a unidirectional first outlet valve provided in the outlet, the first outlet valve allowing downstream flow of air out of the pump chamber and limiting upstream flow of air into the pump chamber; and a unidirectional second outlet valve provided downstream relative to the first outlet valve, the second outlet valve allowing downstream flow of air and limiting upstream flow of air;

wherein a valve leakage of the second outlet valve is lower than the valve leakage of the first outlet valve, the valve leakage being defined as the flow rate of air leaking through the valve in the upstream direction, when the valve is closed.

2. A hearing aid according to claim 1, wherein a buffer chamber is defined between the first outlet valve and the second outlet valve.

3. A hearing aid according to claim 2, wherein a valve opening velocity of the first outlet valve is higher than the valve opening velocity of the second outlet valve, the valve opening velocity being defined as the time it takes the valve to change from a closed state to an open state when the valve is subjected to a predetermined relative pressure.

4. A hearing aid according to claim 2, wherein a pump is arranged in the pump chamber or defines the pump chamber.

5. A pump arrangement for use in a hearing aid according to claim 2.

6. A hearing aid according to claim 1, wherein a valve opening velocity of the first outlet valve is higher than the valve opening velocity of the second outlet valve, the valve opening velocity being defined as the time it takes the valve to change from a closed state to an open state when the valve is subjected to a predetermined relative pressure.

7. A hearing aid according to claim 6, wherein a pump is arranged in the pump chamber or defines the pump chamber.

8. A hearing aid according to claim 1, wherein a pump is arranged in the pump chamber or defines the pump chamber.

9. A hearing aid according to claim 8, wherein the pump is a receiver.

10. A pump arrangement for use in a hearing aid according to claim 1.

* * * * *